United States Patent [19]

Ichikawa et al.

[11] Patent Number: 5,028,916

[45] Date of Patent: Jul. 2, 1991

[54] ACTIVE MATRIX DISPLAY DEVICE

[75] Inventors: Osamu Ichikawa; Toyoki Higuchi, both of Tokyo, Japan

[73] Assignee: Kabushiki Kaisha Toshiba, Kawasaki, Japan

[21] Appl. No.: 607,750

[22] Filed: Oct. 31, 1990

Related U.S. Application Data

[63] Continuation of Ser. No. 332,424, Mar. 31, 1989, abandoned, which is a continuation of Ser. No. 127,554, Dec. 2, 1987, abandoned, which is a continuation of Ser. No. 778,085, Sep. 20, 1985, abandoned.

[30] Foreign Application Priority Data

Sep. 28, 1984 [JP] Japan ..... 59-201529

[51] Int. Cl.[5] ..... G09G 3/36

[52] U.S. Cl. ..... 340/784; 340/719; 340/811

[58] Field of Search ..... 340/718, 719, 765, 784, 340/811, 812; 350/332, 333

[56] References Cited

U.S. PATENT DOCUMENTS

| | | | |
|---|---|---|---|
| 3,668,688 | 6/1972 | Schmersal | 340/718 |
| 3,787,834 | 1/1974 | Elliott . | |
| 4,036,553 | 7/1977 | Borel et al. | 340/752 |
| 4,110,662 | 8/1978 | Greenich et al. | 340/719 |
| 4,317,115 | 2/1982 | Kawakami et al. | 340/784 |
| 4,395,709 | 7/1983 | Nagae et al. | 340/784 |
| 4,427,997 | 1/1984 | Hareng et al. | 340/784 |
| 4,468,659 | 8/1984 | Ohba et al. | 340/719 |
| 4,471,347 | 9/1984 | Nakazawa et al. | 340/719 |
| 4,574,280 | 3/1986 | Weber | 340/718 |
| 4,600,274 | 7/1986 | Morozumi | 340/784 |
| 4,602,292 | 7/1986 | Togashi et al. | 340/784 |
| 4,613,855 | 9/1986 | Person et al. | 340/719 |
| 4,633,242 | 12/1986 | Sekiya | 340/719 |
| 4,644,338 | 2/1987 | Hoki et al. | 340/719 |
| 4,646,074 | 2/1987 | Hashimoto | 340/719 |

FOREIGN PATENT DOCUMENTS 58-23473 5/1983 Japan .

OTHER PUBLICATIONS

Liquid Crystal Display Device and its Drive Method Japanese Patent Disclosure (KOKAI) No. 59-48738 Kabushiki Kaisha Suwa.

Active Matrix Display IC Substrate Japanese Patent Disclosure (KOKAI) No. 59-58480 Kabushiki Kaisha Suwa Seiko-Sha.

*Primary Examiner*—Jeffery A. Brier

*Attorney, Agent, or Firm*—Oblon, Spivak, McClelland, Maier & Neustadt

[57] ABSTRACT

In a thin-type liquid crystal display device of this invention, a display section is formed on a printed circuit board and has a matrix array of display cells, address lines connected to the row arrays of the display cells and data lines connected to the column arrays of the disply cells. Row and column switching selectors are provided on the printed circuit board. The respective selectors include a parallel array of switches, such as TFTs. The row selector is connected to the address lines for sequentially selecting address lines through a scanning operation for image display. The column selector is connected to the data line for subjecting an incoming frame of image data to a time-division multiplexing and for sequentially supplying block-segmented image data components to the data lines.

13 Claims, 13 Drawing Sheets

70
78'
80'
74'
86'
88'
72
76
84
82
76'
84'
82'
TFT ACTIVE MATRIX
74
80
78
88
92'
90'
90
92
86
CON-
TROLLER
94
96
98
100
102

Hz

ACTIVE MATRIX DISPLAY DEVICE

This is a continuation of application Ser. No. 07/332,424, filed on Mar. 31, 1989, now abandoned, which is a continuation of application Ser. No. 07/127,554, filed on Dec. 2, 1987, now abandoned, which is a continuation of application Ser. No. 06/778,085, filed on Sept. 20, 1985, now abandoned.

BACKGROUND OF THE INVENTION

This invention relates generally to a thin type display device with a matrix array of pixels and, more particularly, a thin type display panel including a display section having a built-in active matrix using thin film transistors (TFTs) and a display drive circuit section.

Recently, a growing demand has been made for a thin type display device, such as an electroluminescent (EL) panel, plasma display device and liquid crystal (LC) display device, to be used as a display device for terminal units of a measuring apparatus, business machine and computer in place of a conventional cathode ray tube (CRT). Greater attention has been paid to liquid crystal (LC) display devices in view of their low dissipation power and cost.

According to the LC display device, switching elements, such as thin film transistors, are formed in a matrix array in the display area of a substrate to provide an active matrix. The image data is stored for a predetermined time for each point (pixel) of the switching transistor matrix and a pixel (or cell) area of the liquid crystal layer is correspondingly oriented according to the stored image data. In this way, a desired image is displayed on a display area. The LC display device with a switching transistor matrix array performs a full-time image display and assures a high-quality reproduction image. The thin film transistor of the LC display device can relatively easily be formed on a glass substrate, using the thin film technique for a polycrystalline semiconductor and amorphous semiconductor. It is, therefore, considered that it is possible to implement a thin type display panel of a larger area as required.

In actual practice, however, it is difficult to achieve a liquid crystal display panel of a larger display area with a better cost performance. If the active matrix size (panel size) of the LC display device is increased, the electric display device operation becomes complex by that extent and thus the peripheral drive circuit configuration also becomes complex. In a conventional LC display device with a switching transistor matrix array, the display drive circuit is formed with a plurality of IC chips, such as IC memories, IC data selectors and IC decoders, arranged on a special printed circuit board other than a display substrate. The display drive circuit is connected by a wire bonding method to the display substrate. If, with the greater complexity of the drive circuit configuration, the interconnection pattern of the circuit board and bonding pad pattern are microminiaturized as appreciated from, for example, a pattern pitch of about 100 to 150 $\mu$m, it would be difficult to manufacture the display drive substrate, as well as to perform a wire bonding connection treatment. This leads to a low manufacturing yield of the LC display device. Furthermore, with an increase in the display area of the panel, a selective drive operation is delayed at the active matrix and a response speed (display operation) at the panel is delayed by that extent.

SUMMARY OF THE INVENTION

It is accordingly an object of this invention to provide a new and improved display device of a thin type which can perform a fast and efficient display drive operation with a simplified circuit configuration.

In the thin-type display device of this invention, a display section is provided on a printed circuit board and has a matrix array of display cells, address lines connected to the row arrays of the display cells and data lines connected to the column arrays of the display cells. First and second selection circuit units are provided on the printed circuit board to dynamically drive an image display on the display section in a time-division multiplex fashion. The first selection circuit unit is connected to the address lines for scanning the address lines in the time-division multiplexed fashion for image display on a display section. The second selection circuit unit is connected to the data lines for subjecting an incoming frame of image data to a time-division multiplexing and for sequentially supplying block-segmented image data components to the data lines in accordance with a predetermined time order. Both the first and second circuit units are dynamically performed in the time-division fashion, thereby simplifying a signal interconnection pattern necessary for the transfer of the image data for display on the display section.

BRIEF DESCRIPTION OF THE DRAWINGS

This invention is best understood by reference to the accompanying drawings in which:

FIGS. 13A to 15P show the waveforms of major signals which are generated on the major portions of the circuit arrangement of FIG. 12;

FIGS. 20A to 21B are waveforms for explaining the pulse generation timing of an address scanning signal with a brief high level time set.

DETAILED DESCRIPTION OF THE PREFERRED EMBODIMENT

Figure 1:
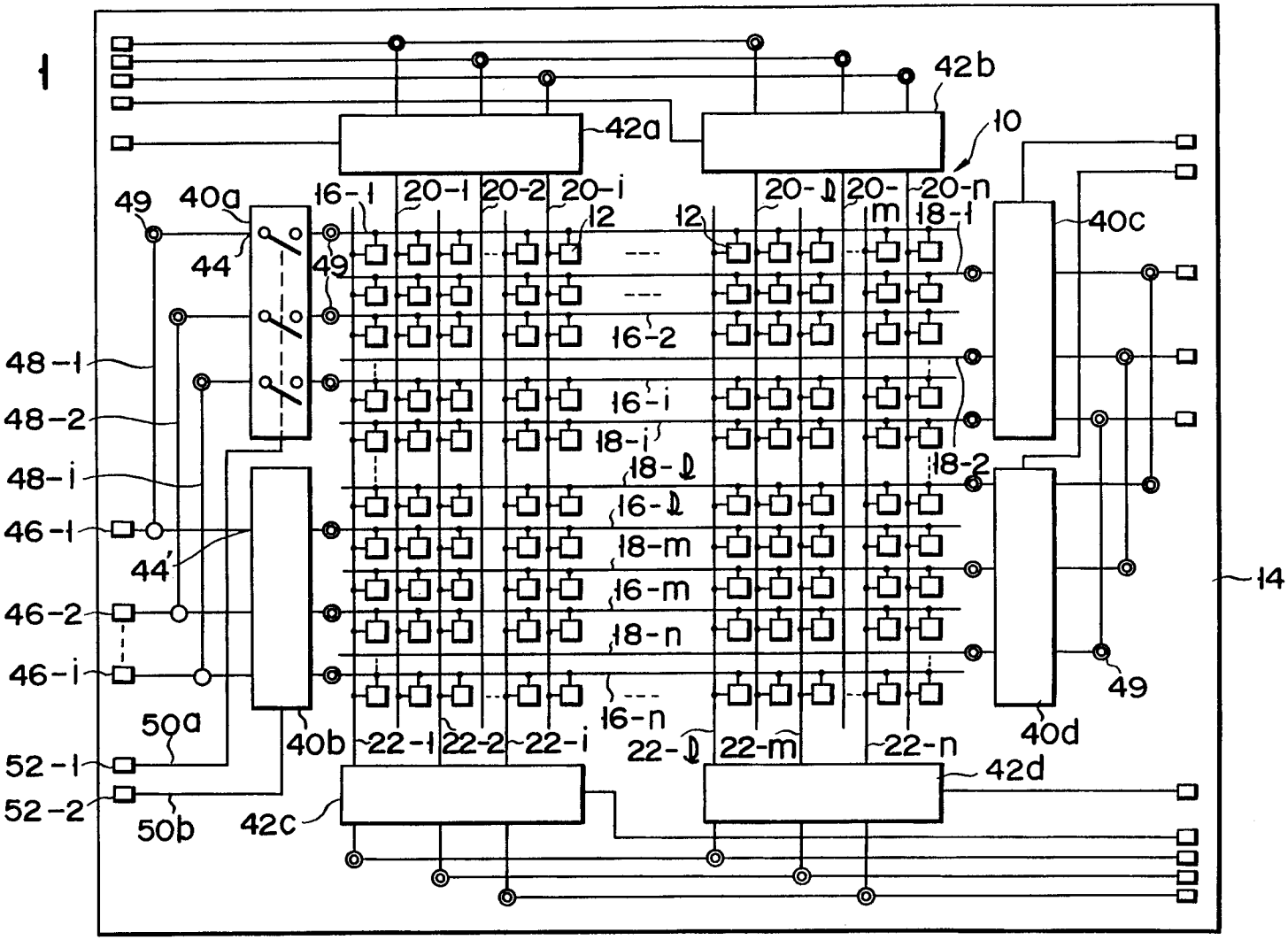
FIG. 1 is a model diagram schematically showing the planar configuration of a major section of a thin type liquid crystal display substrate according to a preferred embodiment of this invention which includes an active matrix display section.

According to a liquid crystal display panel of one preferred embodiment of this invention, illustrated in FIG. 1, a large-size display section 10 is formed with a larger number of pixels (or cells), for example, 480×640 pixels, arranged on a transparent substrate. Since the liquid crystal display panel has a larger number of pixels, it permits a computer image and video image to be displayed with high definition, unlike a conventional CRT display unit.

FIG. 1 is an illustrative representation showing an active matrix display section and peripheral circuit configuration as a model on a panel in order to obtain a visual understanding. In FIG. 1, the matrix array section 10 including 480×640 pixels (cells) 12, made of thin-film transistors (TFTs) is formed on a central area of a transparent glass substrate 14 with the number of the pixels 12 corresponding to that of the pixels of the thin-type display. Address lines 16-1, 16-2, 16-i . . . , 16-l, 16-m, 16-n, . . . ; 18-1, 18-2, 18-i . . . , and 18-l, 18-m, 18-n extend in the row direction of the matrix array on the substrate 14. The address lines 16-1, 16-2, 16-i . . . are alternated with the address lines 18-1, 18-2, 18-i . . . with one of the row cell arrays sandwiched between each of the address lines 16-1, 16-2, 16-i . . . and the next adjacent one of the address lines 18-1, 18-2, 18-i . . . ; and the address lines 18-l, 18-m, 18-n, . . . are alternate with the address lines 16-l, 16-m, 16-n . . . with one of the row cell arrays sandwiched between each of the address lines 18-l, 18-m, 18-i, . . . and the next adjacent one of the address lines 16-l, 16-m, 16-n . . . Data lines 20-1, 20-2, 20-i . . . ; 20-l, 20-m, 20-n . . . ; 22-1, 22-2, 22-i . . . ; and 22-l, 22-m, 22-n . . . extend in the column direction of the matrix array on the substrate 14. The data lines 22-1, 22-2, 22-i are alternate with the data lines 20-1, 20-2, 20-i . . . with one of the column cell arrays sandwiched between each of the data lines 22-1, 22-2, 22-i and the next adjacent one of the data lines 20-1, 20-2, 20-i . . . ; and the data lines 22-l, 22-m and 22-n . . . are alternate with the next adjacent data lines 20-l, 20-m, 20-n with one of the column cell arrays sandwiched between each of the data lines 22-l, 22-m, 22-n . . . and the next adjacent data lines 20-l, 20-m, 20-n . . . .

Figure 2:
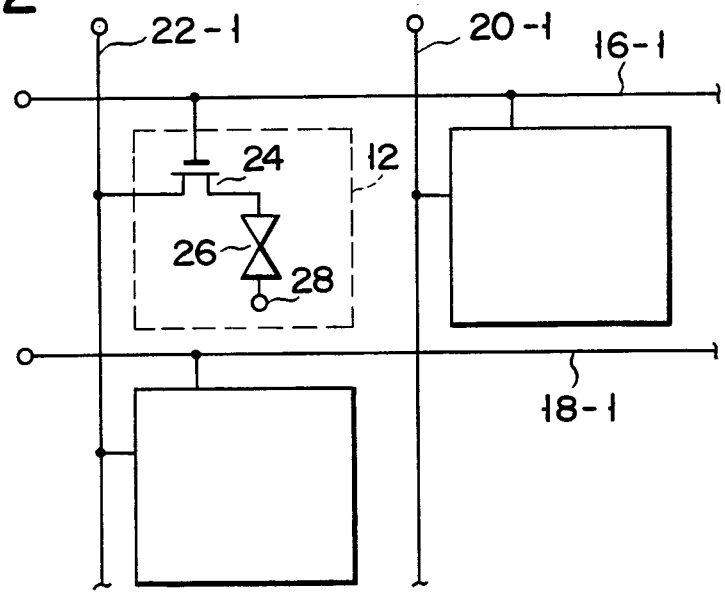
FIG. 2 is a diagram showing an equivalent circuit for display cells in the active matrix display section.

FIG. 2 is an expanded view showing part of the pixel (or cell) matrix 10. Within one cell 12, the gate and source of a thin-film transistor (TFT) 24 are connected to the address line 16 and data line 22, respectively. The drain of TFT 24 is connected to a terminal 28 through a liquid crystal layer 26. The other cells are substantially the same in their internal configuration as that of the cell 12.

Figure 3:
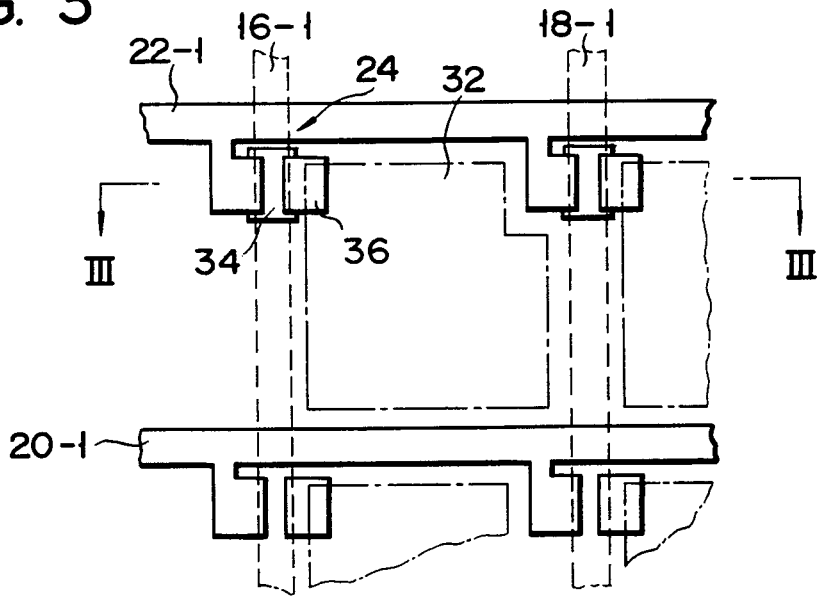
FIG. 3 is a diagram showing a detailed interconnection pattern on the display cell substrate of FIG. 2.
Figure 4:
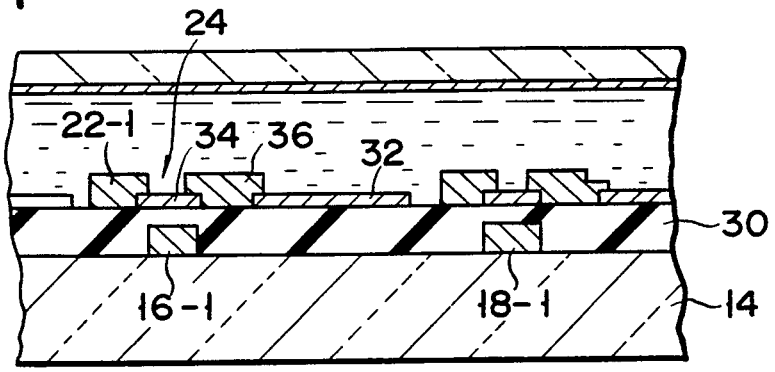
FIG. 4 is a cross-sectional view, as taken along line III—III in FIG. 3, showing the display cells.

The partial planar structure and cross-sectional arrangement of the cell matrix 10 are shown in FIGS. 3 and 4. In FIG. 3, the substrate 14 is omitted for illustrative convenience only. The configuration of one cell will be explained with reference to FIGS. 3 and 4. An insulating layer, such as a silicon oxide layer 30, is formed on the glass substrate 14. The address lines 16-1 and 18-1 extend on the substrate 14 in a manner buried by the silicon oxide layer 30. A cell 32 substantially defining the cell zone, as well as TFT 24, is formed on a cell formation zone of the silicon oxide layer 30. According to this embodiment, the cell electrode 32 is comprised of ITO (indium tin oxide) film. The cell electrode 32 is planar in configuration as shown in FIG. 3 to substantially cover a substantially rectangular zone defined by the address lines 16-1 and 18-1 and data lines 20-1 and 22-1. A semiconductor thin film 34 which is made of, for example, an amorphous silicon is discretely formed as an island on the insulating layer 30. The semiconductor thin film 34 is formed at a junction between the address line and data line. The semiconductor thin film 34 is connected at one end to the address line 22 (or 20) and at the other end to a cell electrode 32 through a drain electrode 36 to provide a switching element.

Referring back to FIG. 1, selector units 40 and 42 are disposed on the substrate 14 at the periphery of the cell display section 10 made of the abovementioned active matrix and include switch arrays made of a plurality of switches. Although, in FIG. 1, four pairs of switching selectors (40, 42) are arranged with the corresponding lines connected between the corresponding pair of switching selectors, they are for an illustrative purpose only and, in actual practice, more selector units are provided with respect to the address lines and data lines.

In FIG. 1, the switching selectors 40 are provided with respect to the address lines 16 and 18. Each switching selector 40*a*, 40*b*, 40*c* or 40*d* has a plurality of outputs connected to the corresponding number of cell rows in the cell matrix array. The switching selectors 42 are provided with respect to the data lines 21 and 22. Each switching selector 42*a*, 42*b*, 42*c* or 42*d* has a plurality of outputs connected to the corresponding number of cell columns in the cell matrix array. In FIG. 1 one (for example, 40*a*) of the selectors are shown, as a representative example, to have three switches S1, S2 and S3 in a parallel array, noting that the other selectors are of the same configuration as that of the selector 40*a* so that they drive the corresponding address lines or the corresponding data lines as in the case of the selector 40*a*.

Input terminals 44 and 44′ of the adjacent selectors 40*a* and 40*b*, respectively, are connected through their corresponding switches to their corresponding address lines and connected in common to each other through a source connection wire 48-1 and to a bonding pad pattern 46-1 formed on the peripheral surface portion of the substrate 14. A double circle as indicated by 49 in FIG. 1 shows a through hole formed in the silicon oxide layer 30. That is, such input lines of the selector 40*a*, each, are brought around onto the opposite surface of the silicon oxide layer 30, noting that the respective input line of the selector 40*a* is electrically connected to the corresponding source connection wire 48 which runs on the opposite surface of the insulating layer 30.

Similarly, the remaining corresponding input lines of the selectors 40*a* and 40*b* are also connected in common to each other through the corresponding source connection wire and to the corresponding one of bonding pad patterns in an array. Gate lines 50*a* and 50*b* of the selectors 40*a* and 40*b* are separately connected to pad patterns 52-1 and 52-2, respectively. The other selectors 40*c* and 40*d*; 42*a* and 42*b*; and 42*c* and 42*d* are connected in exactly the same fashion as set out above in connection with the selectors 40*a* and 40*b*. As a result, the number of pad patterns (46, 52) for the address lines can be reduced down to a total number of one half the number of address lines of the display matrix on the substrate 14 plus the number of the selectors 40, and may be regarded as substantially one half the number of address lines. The same thing can also be true of the number of the pad patterns for the data lines. As a result, the number of the pad patterns necessary on the substrate 14 with the active matrix display unit 10 thereon can be largely reduced down to substantially one-fourth the number of the address and data lines. To explain in another words, if a p number of selectors 40 including an n number of parallel switches are provided for the address lines 16 and 18 on the substrate 14, it is possible to drive the $n \times p$ address lines 16 and 18. Similarly, if a q number of selectors 42 including an m number of parallel switches are provided for the data lines 20 and 22 on the substrate 14, it is possible to drive the $m \times q$ data lines 20 and 22. In this case, the total number of signal input lines required for signal transfer to and from an external control circuit is essentially reduced down to the number $(n+m+p+q)$.

Figure 5:
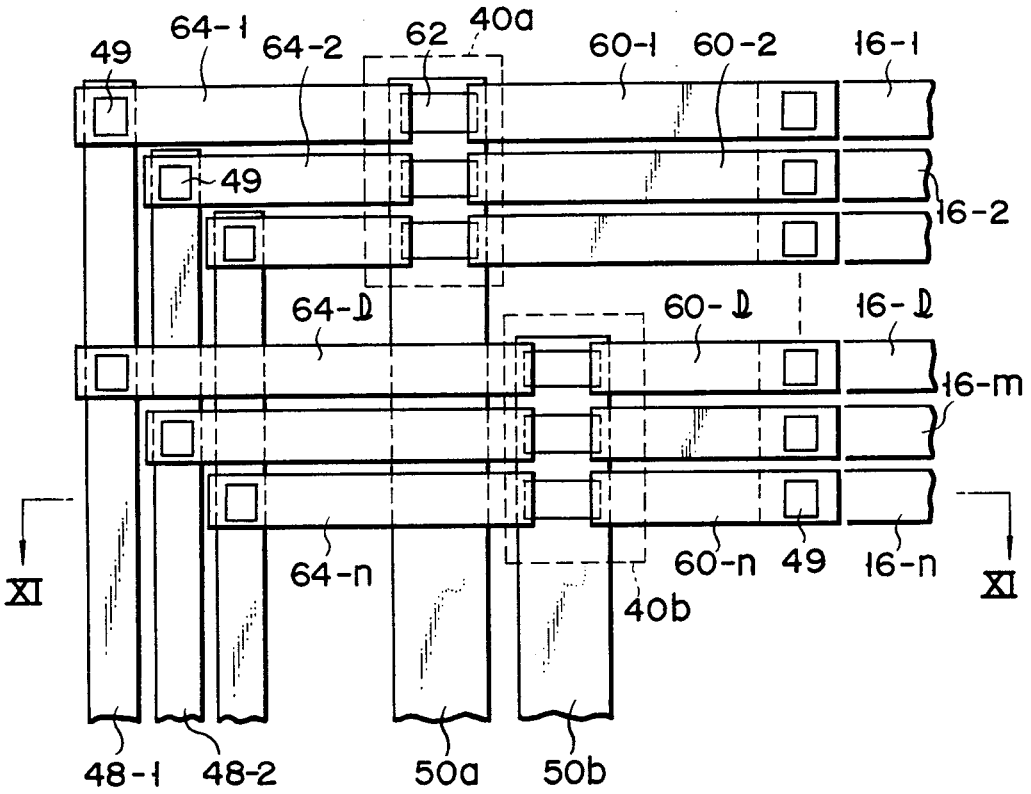
FIG. 5 is a plan view showing a detailed interconnection pattern of a peripheral circuit configuration on the thin type liquid crystal display substrate of FIG. 1.
Figure 6:
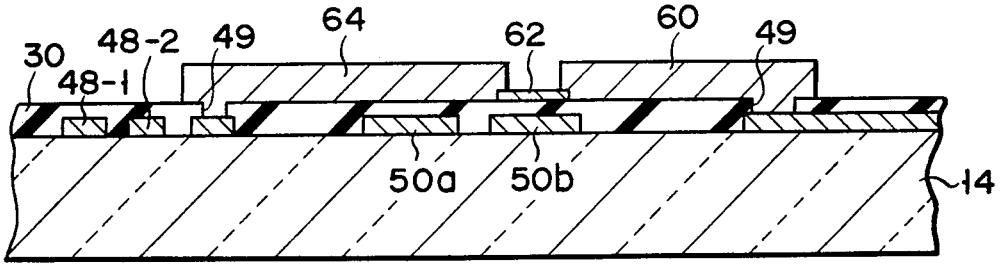
FIG. 6 is a cross-sectional view, as taken along line XI—XI in FIG. 5, showing the display cell configuration.

FIGS. 5 and 6 show a practical interconnection pattern of the associated peripheral circuit arrangement. In the plan view of FIG. 5, the substrate 14 and insulating layer 30 are omitted, and thus the source interconnection wires 48 and common gate lines 50 for the switch selectors 40*a* and 40*b* are shown as extending below the insulating layer 30 as indicated by solid lines in FIG. 5. If an explanation is given about the selector 40*a*, the address lines 16 extracted from the cell matrix 10 extend in a manner sandwiched between the substrate 14 and the insulating layer 30 and are brought around through the corresponding through-holes onto the surface of the insulating layer 30 to permit a connection to be made with peripheral drain interconnection wire (60-1, 60-2, . . . ). The peripheral drain interconnection wire (60-1, 60-2, . . . ) is connected through a thin film 62 to the corresponding peripheral source interconnection wire (64-1, 64-2, . . . ). The peripheral source interconnection wire (64-1, 64-2, . . . ) is connected on the surface of the insulating layer 30 through a corresponding through-hole 49 to peripheral drain interconnection wire (48-1, 48-2, . . . ) on the undersurface of the insulating layer 30. The common gate interconnection wire 50*a* of the selector 40*a* is so formed as to extend on the undersurface of the insulating layer 30. The same thing is also true of another selector 40*b* and further explanation will be omitted.

A display substrate unit for the above-mentioned thin-type display panel is manufactured as follows:

A 2000 Å-thick Mo film is deposited on a glass substrate 14 of 2 mm in thickness, and address lines (16, 18), peripheral source interconnection wire 48 and gate interconnection wire 50 are formed as a first interconnection pattern by virtue of a PEP (Photo Engraving Process). Then, a silicon oxide layer is deposited by a known CVD method on the resultant structure to form an insulating layer 30 ot about 2000 Å in thickness. The above-mentioned through-holes 49 are formed in desired positions in an insulating layer 30. Then, an about 3000 Å-thick amorphous silicon layer is deposited by the CVD method on the surface of the insulating layer 30 and a plurality of discretely distributed, island-like, rectangular thin films 34 in FIG. 3 are formed by virtue of the PEP technique.

A 3000 Å-thick transparent conductor layer made of ITO is formed on the resultant structure. The deposited transparent conductor layer is patterned to form a plurality of cell electrodes 32. Then, an about 500 Å-thick Mo layer and about 1 μm-thick Al layer are sequentially deposited by a sputtering or vapor deposition method on the resultant structure to form a drain electrode (within a cell) 36, data lines 20, 22, peripheral drain interconnection wire 60, peripheral source interconnection wire 64 and bonding pad patterns 46, 42 as an interconnection pattern of a second layer. In this connection it is to be noted that an external control circuit for driving the display active matrix is connected to the pad patterns 46 and 52 by a wire bonding or an electrical connection means, such as the pressure contacting of a conductive rubber. Finally, a TFT within the respective cell and TFTs within the switching selector (40, 42) are formed to complete the above-mentioned display substrate unit.

Figure 7:
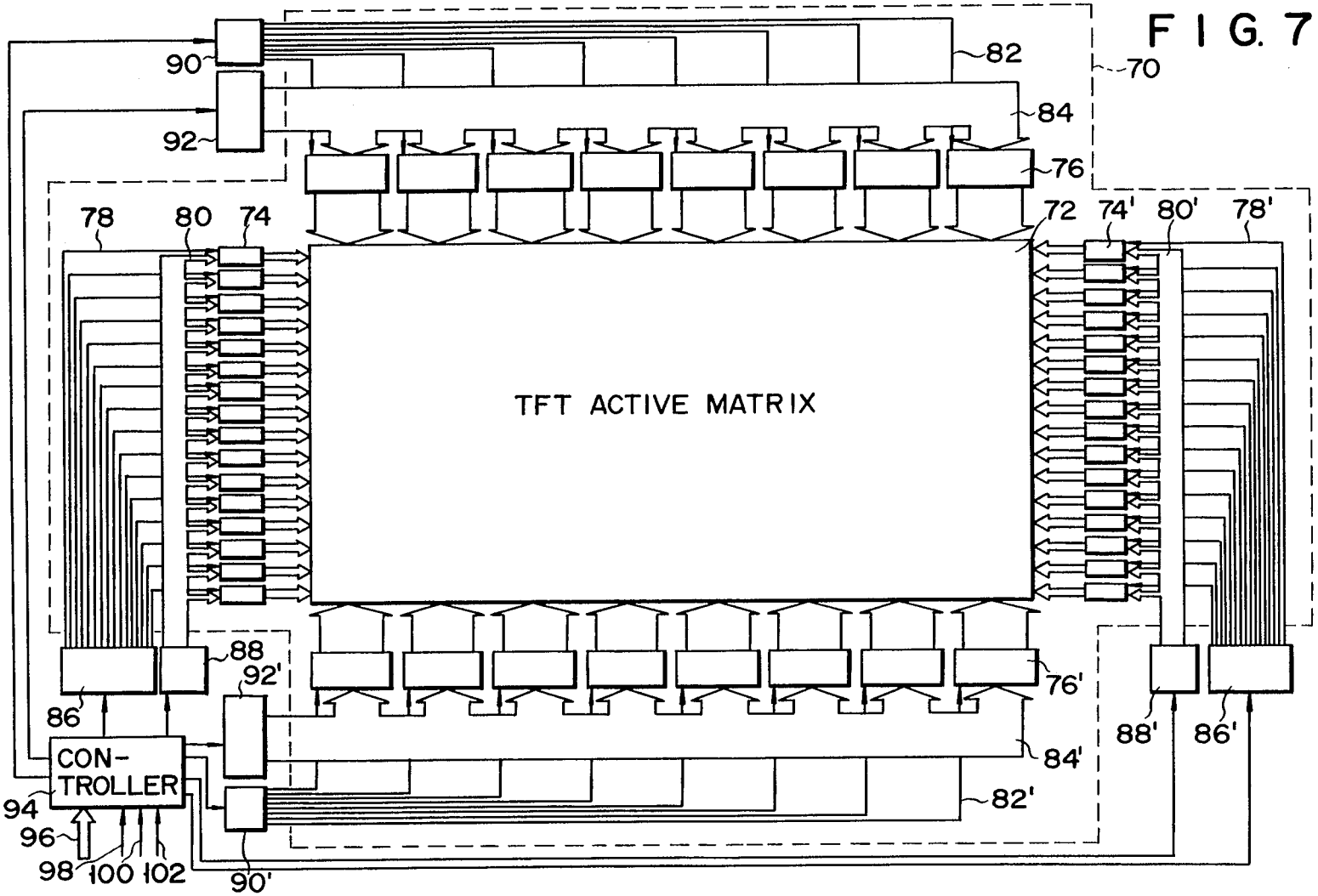
FIG. 7 is a schematic diagram showing the whole planar configuration of a prototype of a liquid crystal display device implemented according to this invention.

FIG. 7 is a schematic diagram showing a whole arrangement of a thin-type LC display device (as a prototype) implemented according to this invention. In FIG. 7, a section 70, as indicated by broken lines, corresponds to the liquid crystal display unit. The TFT active matrix 72 of the display unit 70 is comprised of a $512 \times 640$ number of cells (pixels). Switching selectors 74 are connected to address lines extending in the row direction in the active matrix array 72 and located on both the sides of the active matrix array 72, noting that, in this example, the selector 74 contains 16 switches. Selectors 76 are connected to data lines extending in the column direction in the active matrix array 72 and located one on the upper side and one on the lower side of the active matrix array 72, noting that the selector includes 40 switches comprised of parallel transistors according to this example. The connection of switch arrays within the selector is substantially similar to that as explained in connection with FIG. 1. That is, a common gate line 78 and a bus line 80 comprised of a group of source interconnection wires are connected to each switch selector 74. Similarly, a common gate line 82 and a data bus line (40 bit data bus) comprised of a group of source interconnection wires are connected to each data selector 76.

A peripheral drive circuit for controlling the display substrate unit 70 in FIG. 7 can be connected by a wire bonding method to the TFT active matrix array 72 through the above-mentioned pad patterns (46, 52) or can be mounted as an IC unit on the same substrate 14 on which the TFT active matrix array 72 is mounted. In either case, the above-mentioned electrical connection is as shown in FIG. 7. The gate lines (78, 78') and address bus lines (80, 80') of the selectors (74, 74') at each side of the TFT active matrix array 72 are connected to an upper address scanning circuit (86, 86') and a lower address scanning circuit (88, 88'), respectively. The address scanning circuits 86, 86' and 88 and 88', data select circuits 90, 90' and block data drive circuits 92, 92' are controlled by a controller 94. A cell signal 96, clock signal 98, horizontal synchronizing signal 100 and vertical synchronizing signal 102 are supplied to the controller 94 from a known circuit, not shown.

According to the thin-type display device, not only the switch selector 40 for address lines, but also switching selector for data lines are controlled in a time-division multiplexed fashion. To diagrammatically explain with reference to the schematic diagram of FIG. 1, the switching selectors 40 are sequentially selected in response to signals on the common gate lines 50 (or 78 in FIG. 7) of the address selectors 40 (or 74 in FIG. 4). Since the source interconnection lines 48-1, 48-2, . . . , 48-i transfer sequentially addressing signals in synchronism with the selection of the selector unit, if the address switch selector 40*a* is selected, the switches within the selector 40*a* are sequentially turned ON to activate the corresponding address lines. After the switches within the selector 40*a* are so sequentially turned ON, the same operation is performed within the address switching selector 40*b*. While, on the other hand, during the period when one address line is energized, the selectors 42 for the data lines are sequentially selected. In other words, the time at which the addressing signal is applied to one address line is divided in accordance with the number of the selectors 42. When one selector (for example, 42*a*) is driven within one portion of the divided times, all the switches within the selector 42*a* are turned ON so that the corresponding image data are supplied to all the data lines, at a time, in the selector 42*a*. By so doing, the corresponding image components are displayed at a cell array area of the display section which is determined by the energized address lines and energized data lines. A voltage corresponding to the image data to be displayed is applied to the cell electrode in the cell array through the turned-ON TFT 24, causing the corresponding liquid crystal zone to have a corresponding liquid crystal orientation. By the block-segmented display drive system, a desired frame image can be displayed on the active matrix display section and thus on the display unit 72.

Figure 8:
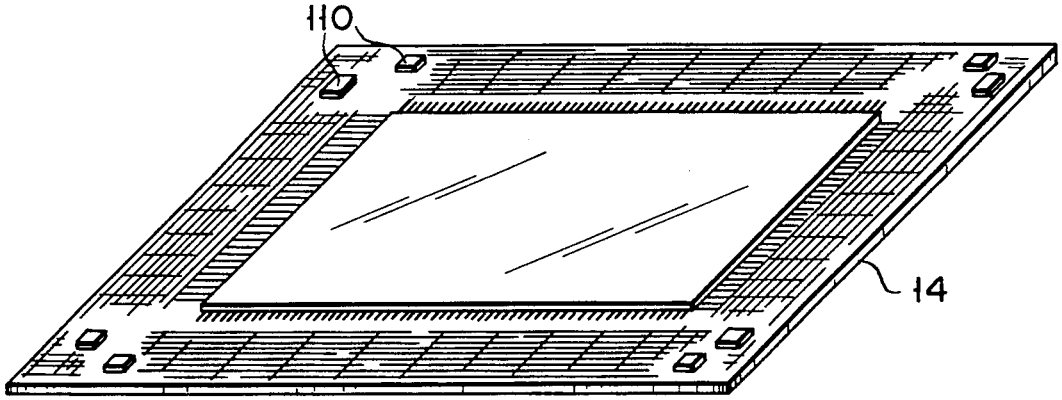
FIGS. 8 and 9 are schematic views showing a detail of a typical liquid crystal display device having the above-mentioned circuit configuration.

Several practical thin-type display devices of this invention will be explained below, as typical examples. In FIG. 8, peripheral drive circuits, such as data selectors 90, 90', block data drive circuits 92, 92' and address scanning circuits 86, 88, 86', 88' in FIG. 7, except for the display unit 70 in FIG. 7 are mounted, as several IC units 110, on the same substrate 14 at the periperal portion of the TFT active matrix array 72. The core concept of this invention is based on the above-mentioned block-segmented display drive system for driving selectors for address lines and data lines in the block-segmented fashion, with the result that the number of the interconnection patterns on the display substrate can be maximally reduced. That is, the above-mentioned block-segmented display drive system has the following advantages. For the address lines 16 and 18 on the active matrix array 72 it is only necessary to provide two (i.e. upper and lower) address scanning ICs at each side of the active matrix array 72. For the data lines 20 and 22 on the active matrix array 72, it is only necessary to provide two ICs, that is, the data selector IC and driver IC, at each side of the active matrix array. These arrangements greatly simplify the peripheral circuit arrangement. According to the arrangement, the predetermined input signal reception terminal patterns receive external pixel data and scanning signals and the selectors on the substrate 14 perform the address and data line selection operations in the block-segmented display drive fashion to display a desired frame image on the LC display screen.

Figure 9:
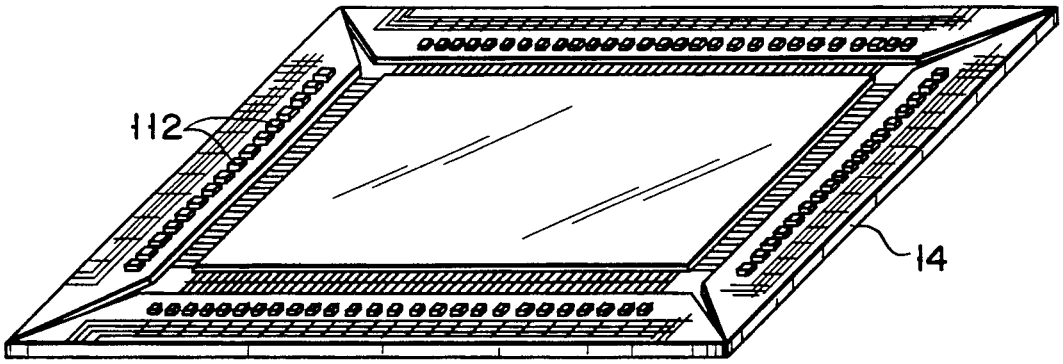
Figure 11:
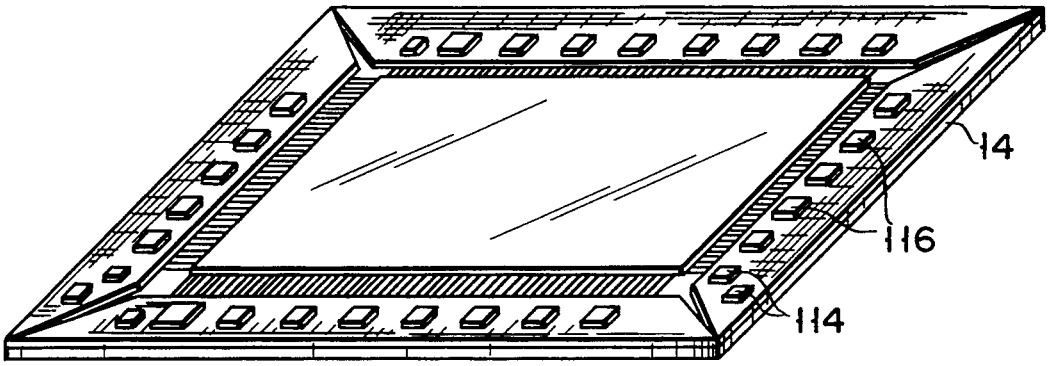
FIG. 11 is a schematic view showing another form of a thin type display device.
Figure 10A:
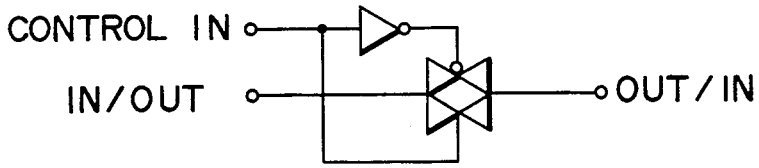
FIGS. 10A to 10C, each, are an internal circuit arrangement of transmission gate IC chips (TMG ICs) for use in switch selectors on the display device of FIG. 9.
Figure 10B:
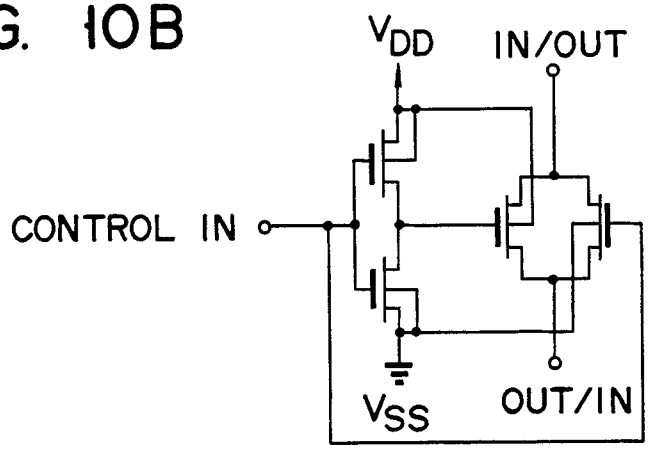
Figure 10C:
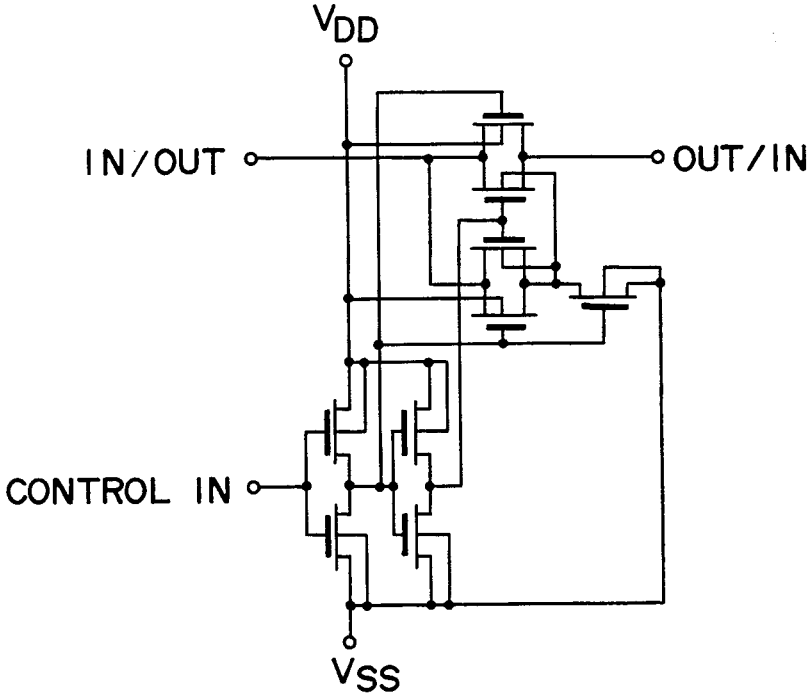

In FIG. 9, the selectors 40 and 42 for address lines and data lines can be implemented utilizing transmission gate IC chips in place of the above-mentioned TFT's. The internal circuit of transmission gate IC chips 112 are as shown in FIGS. 10A to 10C. The increase in the number of such TMG ICs (internal elements) permits a proper combination with the peripheral drive circuit arrangement (FIG. 8) on the IC chip, as seen from an external appearance in FIG. 11. In FIG. 11, 114 denotes ICs, such as data selectors and drivers and 116 denotes TMG ICs.

According to this invention, the interconnection pattern can be greatly simplified on the display unit 70 including the TFT active matrix 72 of a relatively large size. It is also possible to reduce the number of bonding pad patterns necessary for connection by a wire bonding method or an elastomeric connector to the external drive circuit. In consequence, a high response speed with which the display operation is performed is attained and, in addition, the display substrate can be readily manufactured, assuring a high manufacturing yield. Furthermore, the simplification of the interconnection pattern assures further simplification of the peripheral circuit hardware required for an active matrix drive so that the peripheral circuit hardware can be implemented, as shown in FIGS. 7 to 11, with a lesser number of IC chips. A peripheral drive circuit arrangement, which has necessarily been mounted on a special substrate, as the case may be, can be mounted directly on the display substrate as opposed to the conventional display substrate. Thus, the thin-type display device assures an improved operation reliability, as well as a low assembly cost.

Figure 12:
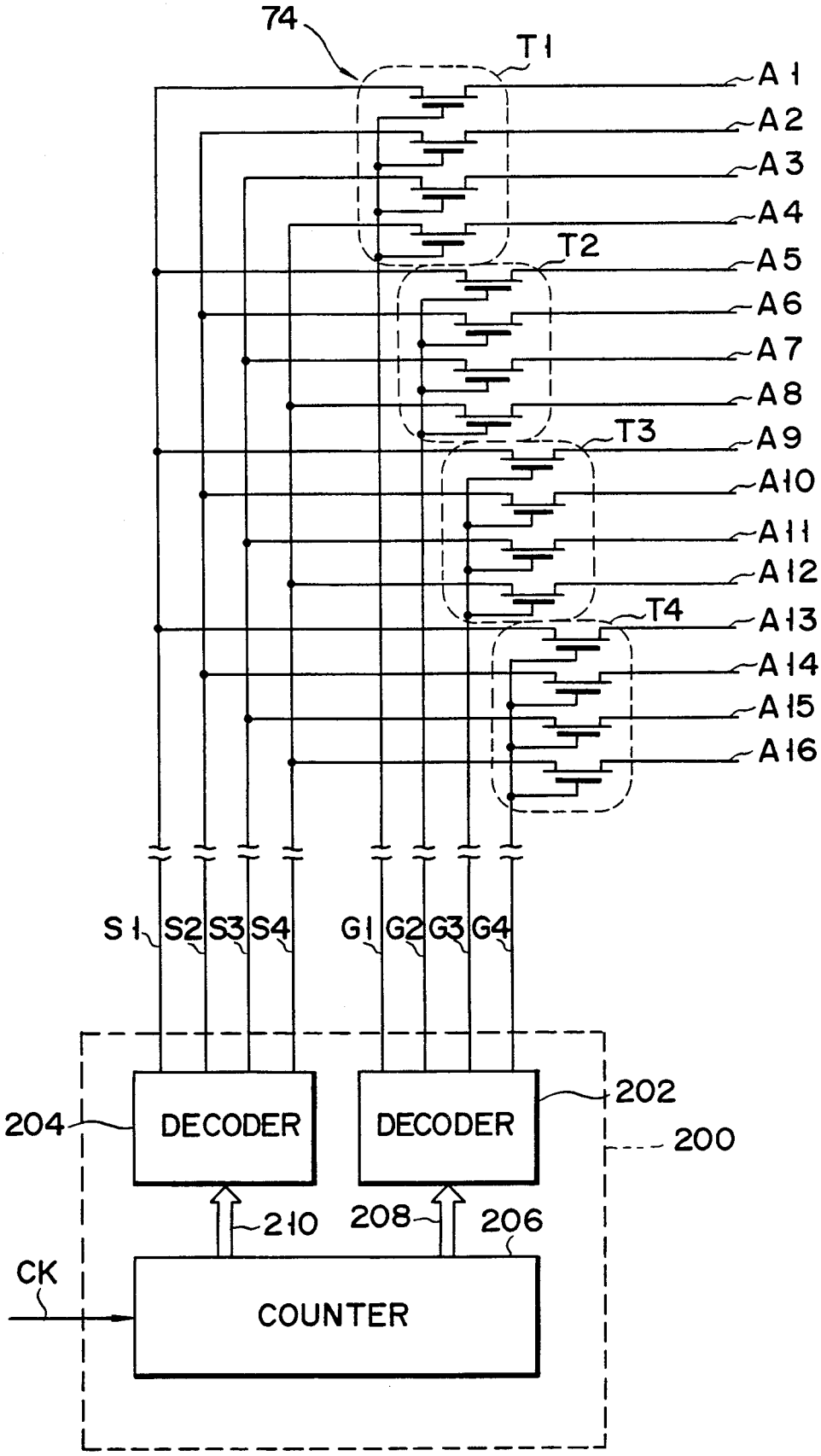
FIG. 12 is a schematic diagram showing an addressing signal generator for performing an addressing control for an addressing line on an active matrix display section on the display device shown in FIG. 7.

The operation of the thin type display device according to the preferred embodiment of this invention will be explained below in more detail. An explanation as to how the addressing control of the active matrix array should be made will be given below with reference to FIGS. 12 and 13. FIG. 12 shows a circuit arrangement for 16 address lines A1 to A16 of four address selectors T1 to T4, with the respective address selector (T1, T2, T3, T4) corresponding to the four address lines (A1 to A4, A5 to A8, A9 to A12, A13 to A16). In FIG. 12, G indicates a common gate line (G1, G2, G3, G4) which is connected to corresponding four FETs in each of the respective address selectors, and S indicates a common source line (S1, S2, S3, S4) which is connected to the respective four FETs in the respective address selector. The lines S and G are connected to an addressing signal generator 200 corresponding to the address scanning circuits 86 and 88. The circuit 200 includes a second decoder 202 connected to the gate lines G1 to G4, a first decoder 204 connected to the source electrode lines S1 to S4, and a counter 206 connected to the decoders 202 and 204.

Figures 13A, 13B, 13C, 13D, 14A, 14B, 14C, 14D, 15A, 15B, 15C, 15D, 15E, 15F, 15G, 15H, 15I, 15J, 15K, 15L, 15M, 15N, 15O, 15P:
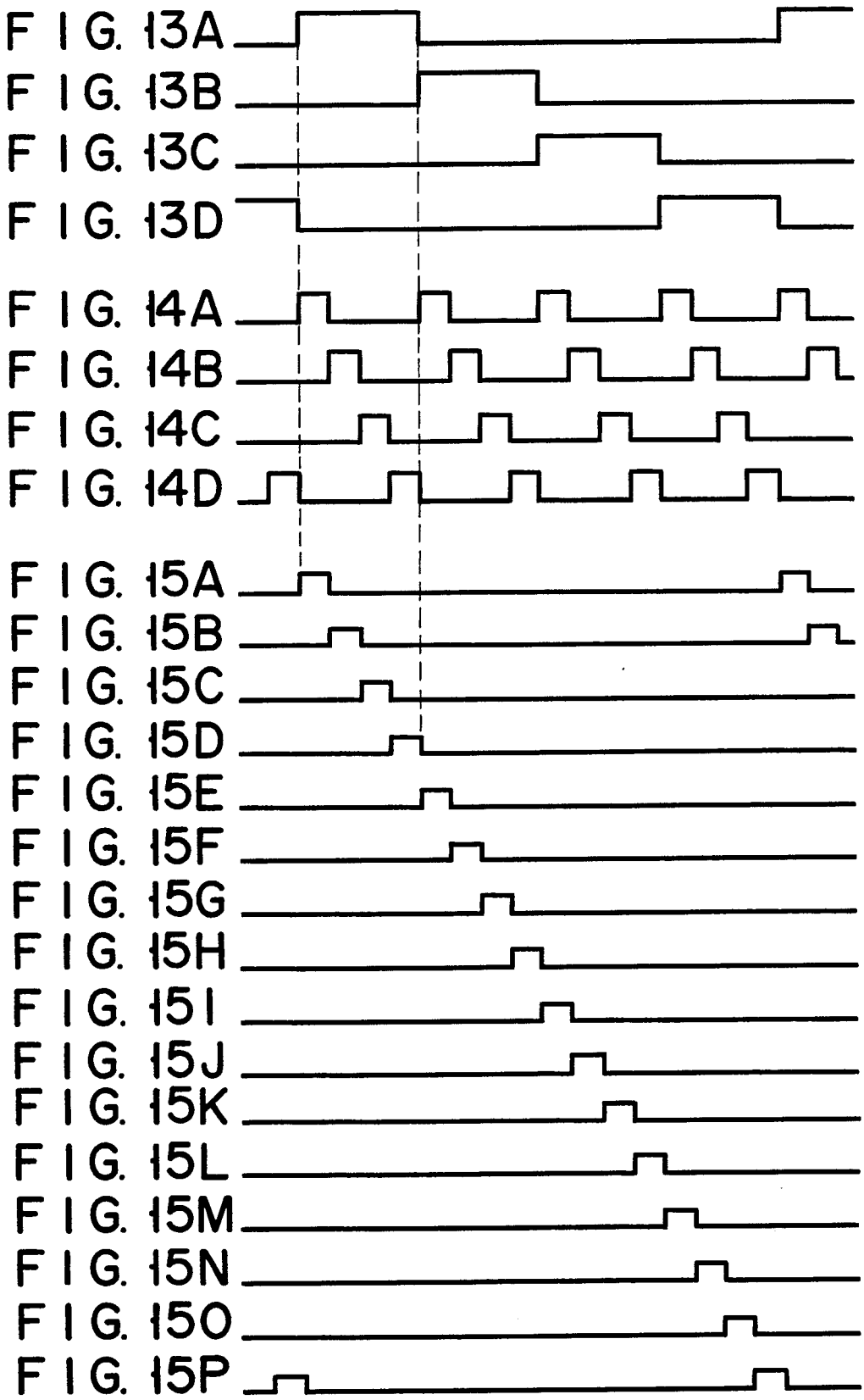

The counter 206 performs a binary count operation in response to a clock signal CK of a predetermined time width to produce a lower two-bit signal 208 and an upper two-bit signal 210. The decoder 202 supplies decoder signals, as indicated by FIGS. 13A, . . . , 13D, to the gate lines G1, . . . , G4. The decoder 204 supplies decoder signals, as indicated in FIGS. 14A, . . . , 14D, to the source electrode lines S1, . . . , S4. Thus, during the ON period of the gate line G1, the source electrode lines S1 to S4 are sequentially turned ON as shown in FIGS. 13A and 14A to 14D. Then, the gate line G2 is turned ON as shown in FIG. 13B, the source electrode lines S1, . . . , S4 are turned ON as shown in FIGS. 14A, . . . , 14D. In this way, the line selection operation is performed as shown in FIGS. 13 and 14. That is, the gate lines G1, . . . , G4 are sequentially turned ON in synchronism with the timing of each complete cycle of the selective scanning of the source electrode lines S1 to S4, thus permitting a sequential selection of the address lines A1 to A16 as shown in FIGS. 15A to 15P. In this connection it is to be noted that these sequential signals can be utilized as the scanning signals on the display unit for the TFT active matrix array. The internal arrangement of the addressing signal generator 200 is not restricted to that shown in FIG. 12. For example, the generator 200 can be replaced by two shift registers in series array.

Figure 16:
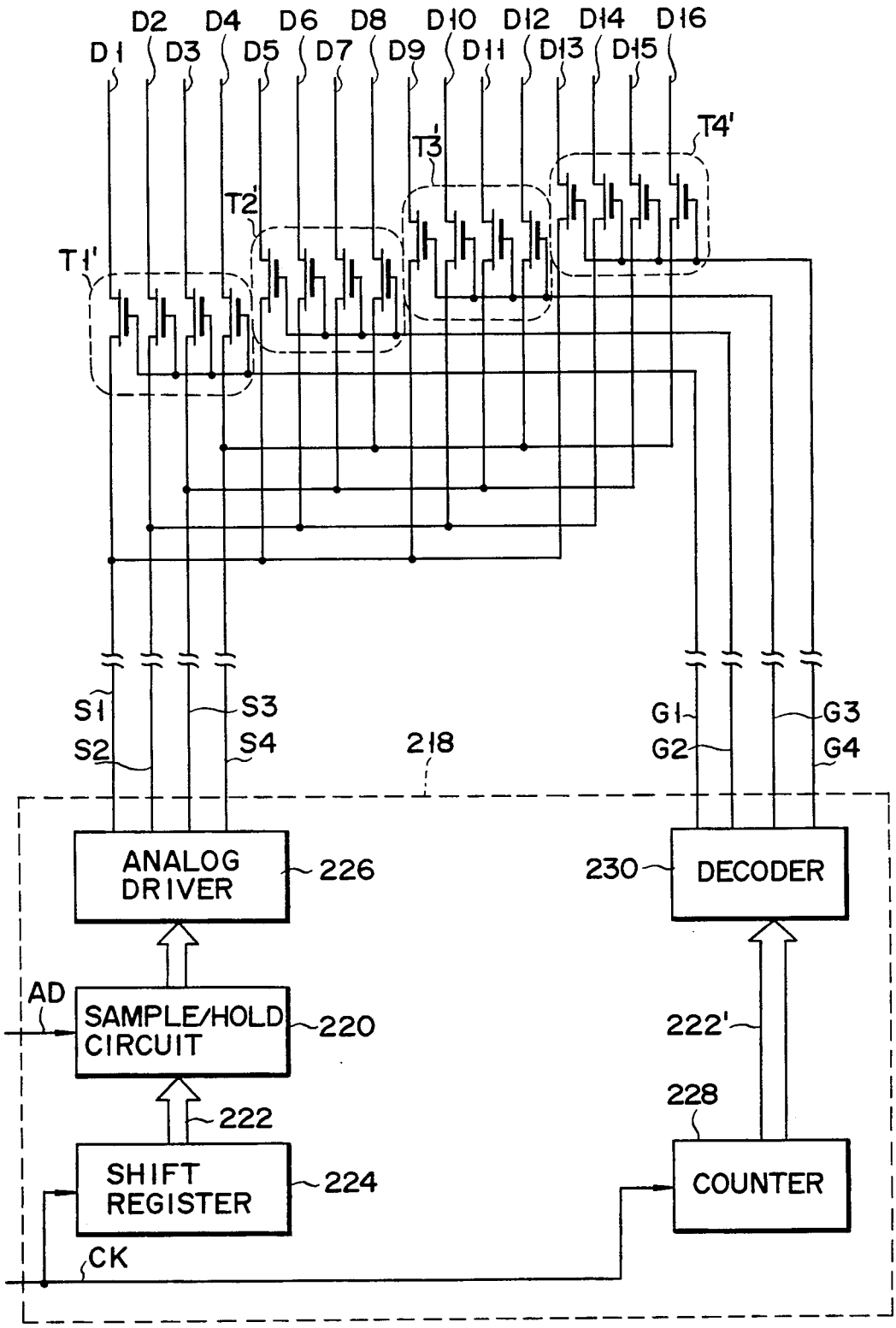
FIG. 16 shows a circuit arrangement (corresponding to a data select circuit and block data drive circuit) for segmenting image data as blocks for the data lines of an active matrix display section on the substrate of the liquid crystal display device of FIG. 7.

An explanation will be given below as to how the image data of the active matrix array is block-segmented. Reference is invited to FIGS. 16 and 17. FIG. 16 shows a circuit arrangement including four data selectors T1', . . . , T4' connected to data lines D1 to D4, D5 to D8, D9 to D12, D13 to D16, respectively. A common gate line (G1, G2, G3, G4) connected to four FETs in each of the switching selectors T1', T2', T3', T4' is connected to a decoder 230, and a source line (S1, S2, S3, S4) is connected to the corresponding source electrode of each of the FET arrays of the switching selectors (T1', . . . , T4') and to an analog driver 226. As a result, four source electrode lines S1, . . . , S4 are taken out of the four data selectors T1' to T4'. These lines S and G are connected to the data block-segmented drive signal generator 218 corresponding to the data select circuit 90 and block data drive circuit 92. An analog image signal AD is stored in a sample/hold circuit 220 in response to an output signal 222 which is generated from the shift register 224 in synchronism with a clock signal CK. The analog signal which is stored in the sample/hold circuit 220 is supplied in a parallel mode to the analog driver where the parallel signals are amplified and taken out as output signals S1 to S4.

Figures 17A, 17B, 17C, 17D, 17E, 17F, 17G, 17H, 17I, 17J, 17K, 17L, 17M, 17N, 17O, 17P, 17Q, 17R, 17S, 17T, 17U, 17V, 17W, 17X:
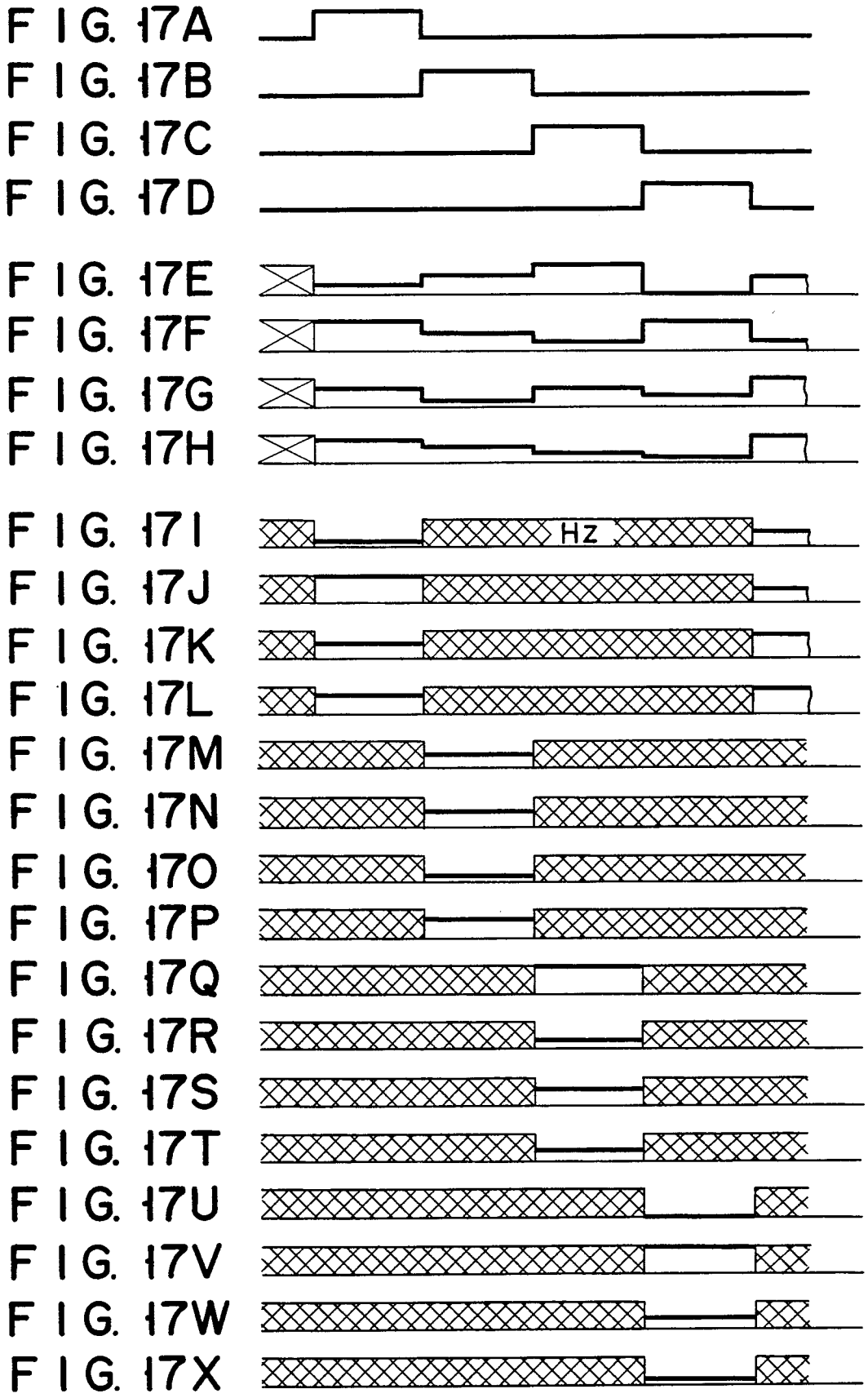
FIGS. 17A to 17X are waveforms showing major signals which are generated on the major section of the circuit arrangement of FIG. 16.

When one complete cycle of the signals S1 to S4 is performed, the shift register 224 is deenergized and a counter 228 is energized to deliver a binary output signal 222' to the decoder 230. In response to the signal 222' the decoder 230 sequentially generates decode output signals G1 to G4 in a switching fashion as shown in FIGS. 17A to 17D. By a combination of analog image data signals on the source electrode lines S1 to S4, on one hand, and the decode output signals on the common gate lines G1 to G4, on the other hand, serving as the block data select lines, the 16 data lines D1 to D16 connected to the switching selectors are sequentially activated, in four units, as shown in FIGS. 17E to 17H in synchronism with a length of time corresponding to the ON periods of the respective decode output signals G1 to G4. Thus, the data lines, such as D1 to D4 or D5 to D8, which are temporarily activated, are responsive to the incoming image data to sequentially deliver the corresponding output signals as shown in FIGS. 17I to 17X. Thus, the cell columns of the active matrix array, which are connected to data lines D, sequentially display the corresponding image data components in a time-division multiplexed fashion. Hz in FIG. 17I denotes a high impedance.

Figure 18:
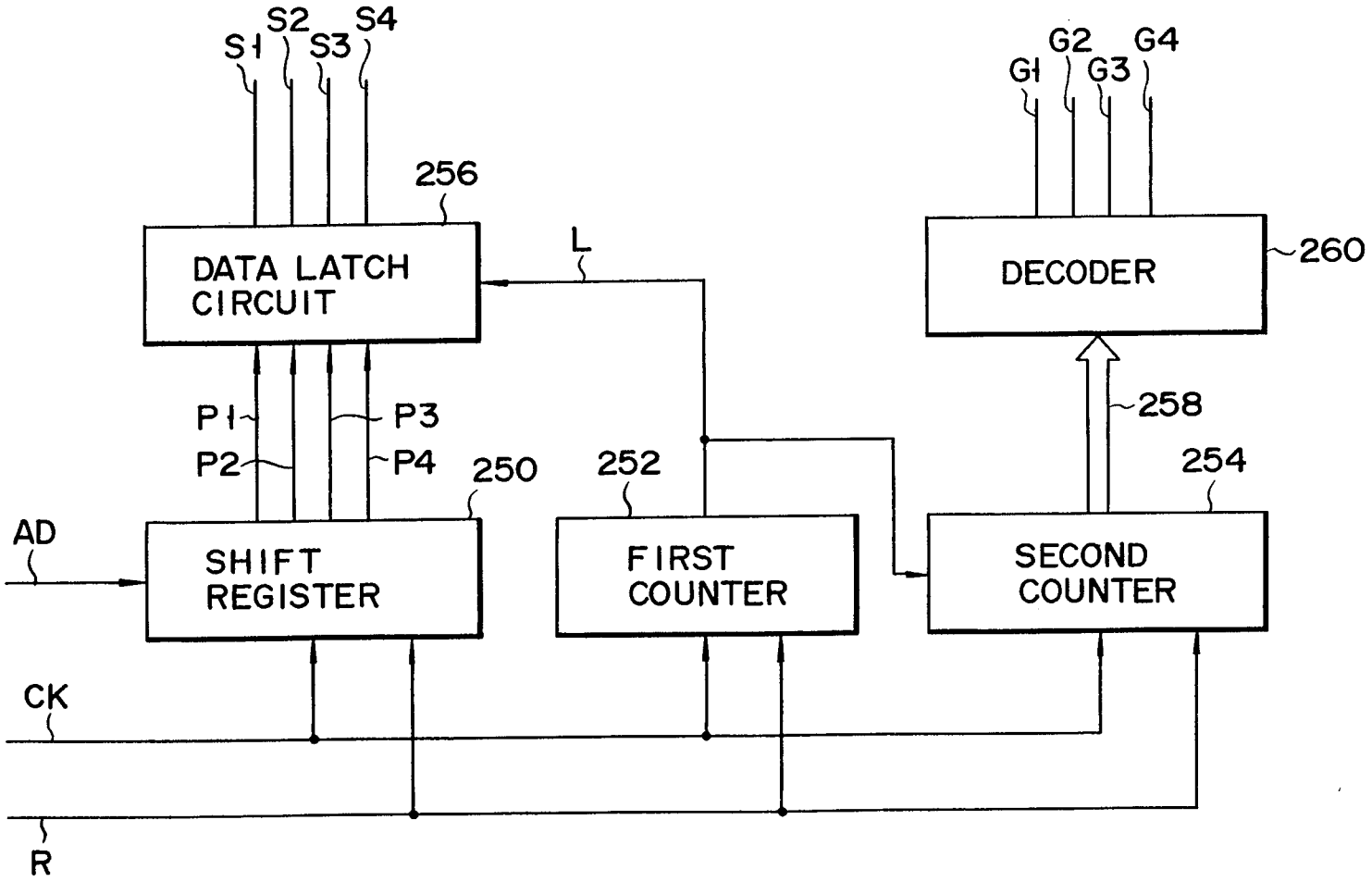
FIG. 18 is a block diagram showing a modified form of the circuit arrangement of FIG. 16.
Figures 19A, 19B, 19C, 19D, 19E, 19F, 19G, 19H, 19I, 19J, 19K, 19L, 19M, 19N, 19O, 19P, 19Q, 19R:
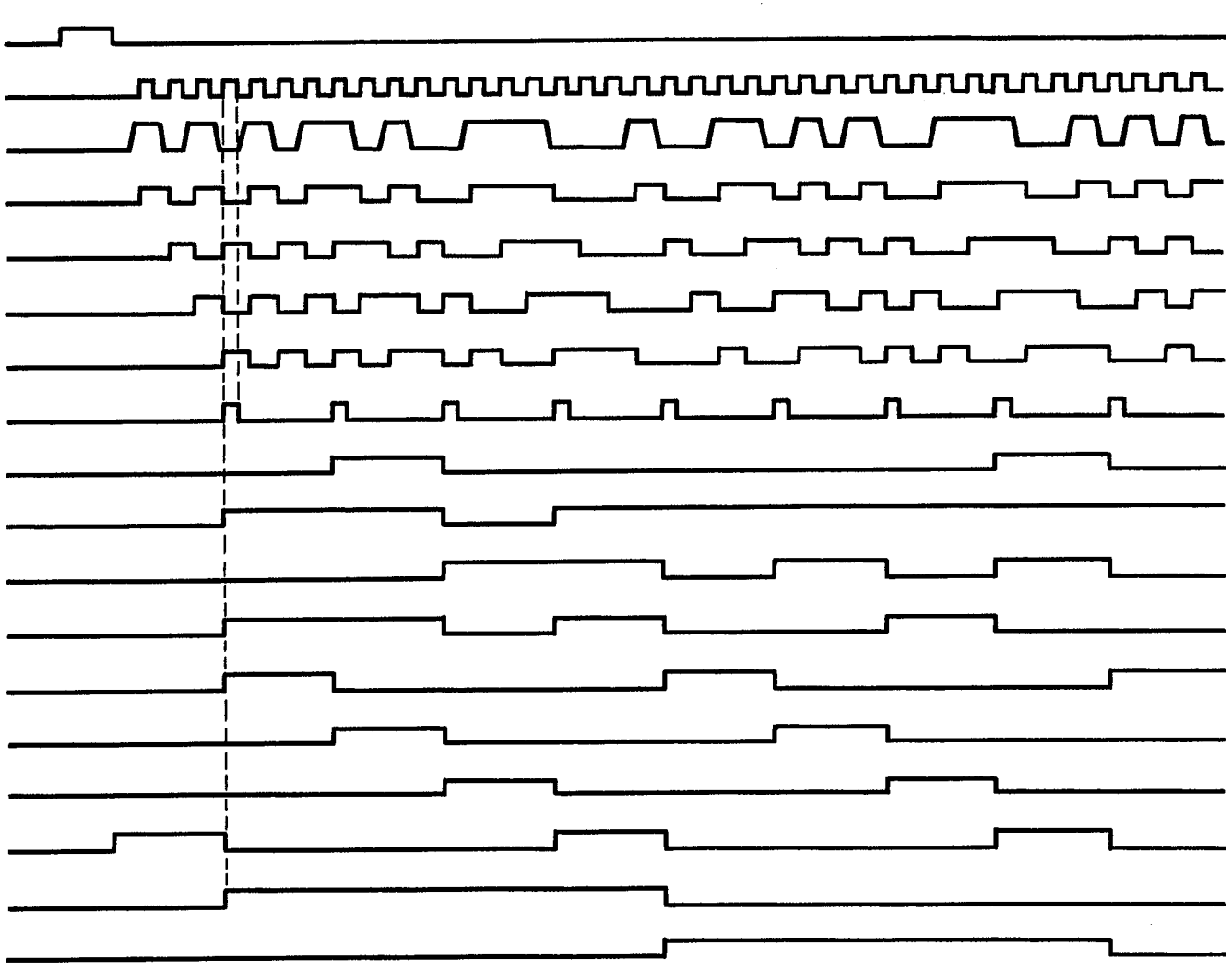
FIGS. 19A to 19R are waveforms showing major signals generated on the major section of the circuit arrangement of FIG. 18.

FIG. 18 shows a modified form of circuit in FIG. 16. In connection with this modification, an explanation is given of a binary image display. In FIG. 18, a shift register 250 and first and second counters 252 and 254 receive a reset signal R of a waveform shown in FIG. 19A for initialization. The shift register 250 receives image data AD as shown in FIG. 19C in synchronism with a clock signal CK as shown in FIG. 19B and supplies shift output signals P1 to P4 (see FIGS. 19D to 19G) to a data latch circuit 256. The first counter 252 counts the number of clock signals CK and supplies a data latch signal L as shown in FIG. 19H each time the shift register 250 receives a train of image data AD. The data latch circuit 256 generates block-segmented image signals S1 to S4 in response to the data latch signal L.

The data latch signal L from the first counter 252 is also supplied to the second counter 254. The second counter 254 supplies a counter output signal 258 to a decoder 260 in response to the latch signal L. The decoder 260 generates the above-mentioned decode output signals G1 to G4 (see FIGS. 19M to 19P) on the basis of the counter output signal 258. The decode output signal G1 is selected, as shown in FIG. 19M, at a time at which a first data latch signal L is generated. In consequence, the image data which are transferred to the source lines S1 to S4 emerge as data lines D1 to D4 as shown in FIG. 16.

Then, the next image data AD is continuously supplied to the shift register 250, while the block data select line G1 is activated. Simultaneously with the generation of fresh shift output signals P1 to P4 from the shift register 250, the next (second) block data select line G2 is selected by the second counter 254 and decoder 260. As a result, the image data S1 to S4 representing the above-mentioned next image data AD appear on the next four data lines D5 to D8, as shown in FIG. 16. In this way, the block-segmented image data are sequentially transferred in the time-division multiplexed fashion onto the data lines on the active matrix display unit with the four data lines D as one unit, such as the lines D9 to D12, D13 to D16, . . . .

The image data output signals on the data lines D1 to D16 which are obtained by the scanning of the block data select lines G1 to G4 are stored for a predetermined time by a time constant determined by:

(1) the OFF resistance of the switching selectors T1' to T4',
(2) the resistive component of the data lines on the display unit, and
(3) a stray capacitance induced at the interconnection pattern of the data lines D and FETs in switching selectors T1' to T4'.

Where, for example, the switching selectors T1' to T4' are made of CMOS transistors and the data lines are made of aluminum lines or wires of about 30 cm in length$\times$20 $\mu$m in width$\times$1 $\mu$m in thickness, then the storage time of the above-mentioned image data will be about 20 msec. If, as in the NTSC system, 252 horizontal lines are scanned on the display plane at a rate of 30 times per second (about 63.5 $\mu$s per scanning line), the percent attenuation of the image data within the data holding time is $3\times10^{-3}$ and is held at 99% even if evaluated on the screen. Thus, if the address scanning period is so set as to occupy each whole write-in time of each block data, the first image block data are written, through the data lines D1 to D4, into the TFTs of the corresponding area of the display unit through the selection of the first block data select line G1 and then the next image block data are written, through the corresponding data lines, into the TFTs of the corresponding area of the display unit through the selection of the corresponding block data select line G2, . . . , so that the sequential image block data are displayed on the display screen with their block intensity level or the image contrast gradually decreased in that display order. As a result, the image quality is degraded on the display screen. Furthermore, during the address scanning period, the image block data which has been written at a final or near-final stage are still persisted continuously as an after-image on the display screen even after the next address line has been selected. This produces an undesirable image defect, such as the emergence of a "double horizontal line".

Figures 20A, 20B, 20C, 20D, 20E, 20F, 21A, 21B:
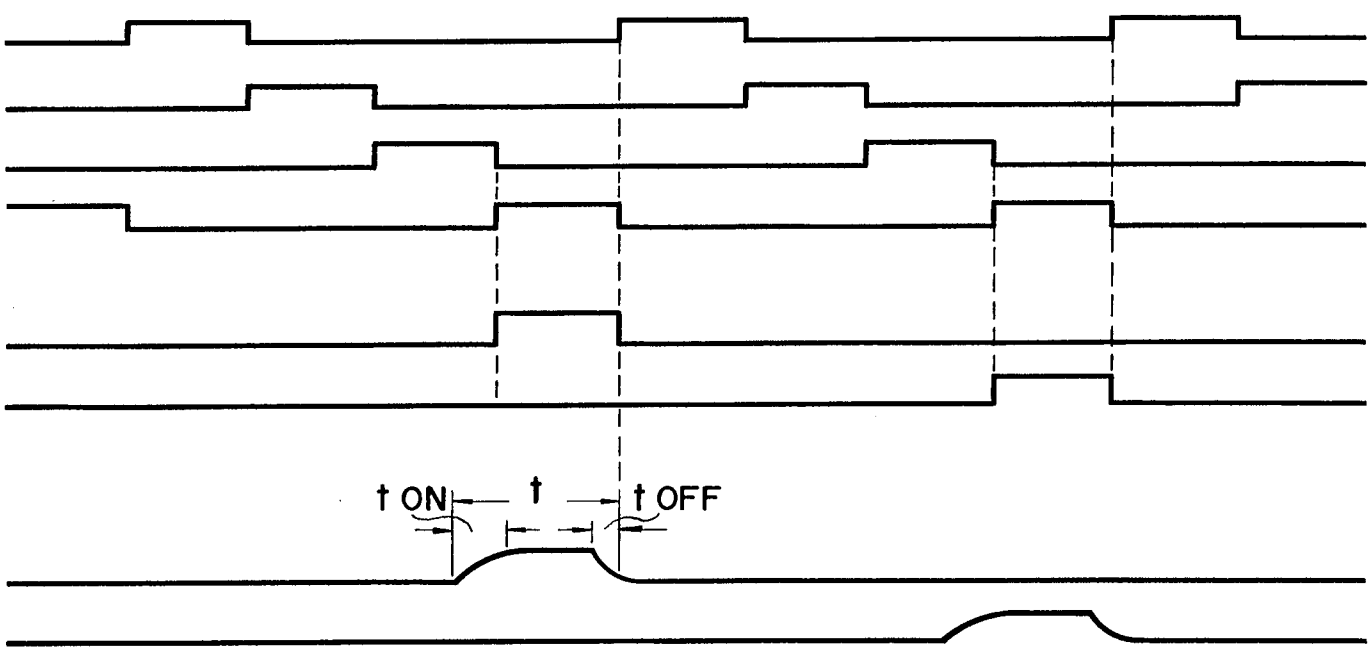

In order to overcome the above-mentioned drawback, the activation period of each address line A is so shortly set to be made equal only to a final one G4 of the four block data select signals G1 to G4, as shown in FIGS. 20E and 20F, without so lengthening the application time of the address scanning signal as to be set to be equal to the whole application time, as shown in FIGS. 19Q and 19R, of the sequentially emerging decode output signals (i.e. the block data select signals) G1 to G4. In this connection it is to be noted that FIGS. 20A to 20D show the same waveforms as those of the signals G1 to G4 as shown in FIGS. 19M to 19P.

The pulse waveforms of the address scanning signals can be forcedly deformed as shown in FIGS. 21A and 21B. As shown in FIGS. 21A or 21B, the waveform of the address scanning signal is set to be substantially equal to that of the signal as shown in FIGS. 20E or 20F by setting rise ($t_{ON}$) and fall ($t_{OFF}$) time constants in accordance with the characteristic of a signal level determined by the capacitive and resistive components in the address lines on the display unit and adjusting the points at which the rise and fall occur. By so doing, it is possible to compensate for an undesired variation in the level of the input signal of the image data resulting from the resistive and capacitive components in the address lines on the active matrix display unit and to improve the quality of the display image on the high-speed scan so that a well-defined image can be reproduced on the display unit.

Although this invention has been shown and described with reference to particular embodiments, various changes and modifications which are obvious to a person skilled in the art to which this invention pertains are deemed to lie within the scope of this invention.

What is claimed is:

1. An active matrix type liquid crystal display device comprising:

a substrate;

a display section formed on said substrate and including a matrix array of display cells, address lines connected to row arrays of the display cells, and data lines connected to column arrays of the display cells;

first switching selectors formed on said substrate so as to be connected to said address lines and having address data applied thereto, for sequentially selecting one of the address lines to provide dynamic addressing of said display cells, each of said first switching selectors comprising an array of a first number of parallel transistors respectively having control electrodes which are connected in common with each other, each transistor having an input;

second switching selectors formed on said substrate and connected to said data lines, for receiving plural block segments of electrical image data representing an image to be displayed on said display section, each of which block segments associated with a respective one of the data lines, and for sequentially applying in a predetermined order during each selection of an address line by said first switching selectors each of the block segments to the respective data lines associated therewith, each of said second switching selectors comprising an array of a second number of blocks of parallel transistors respectively having control electrodes which are connected in common with each other, each of said transistors of said second number of blocks having inputs;

addressing controller means connected to said first switching selectors, for supplying address scanning signals to the control electrodes of the transistors included in said first switching selectors and for causing these transistors to be sequentially rendered conductive; and data division driver means connected to said second switching selectors, for supplying decode output signals as block data select signals to the control electrodes of the transistors included in said second switching selectors, for supplying block-segmented image data components to inputs thereof, and for causing the blocks of said transistors of said second switching selectors to be sequentially rendered conductive with the second number of transistors being as a unit thereby to transfer sequentially said block-segmented image data components to a corresponding data line, said addressing controller means applying each of said address scanning signals to a corresponding address line in a predetermined time period which is shorter than the total application times of said block data select signals to said data lines, said address scanning signals having a specific activation time period which is substantially equal to the application time of a lastly generated one of said block data select signals.

2. The device according to claim 1, wherein each of said address scanning signals has a pulse waveform.

3. The device according to claim 1, wherein each of said address scanning signals has a waveform which changes between first and second signal levels at a predetermined time constant.

4. The device according to claim 1, wherein said addressing controller means comprises:

counter circuit means for receiving a clock signal externally supplied thereto, and for generating first and second binary bit signals;

first decoder means connected to said counter circuit means and the control electrodes of said parallel transistors included in said first switching selectors, for receiving the first binary bit signals, and for supplying decoder output signals to the control electrodes of the transistors included in said first switching selectors; and second decoder means connected to said counter circuit means and the inputs of said parallel transistors included in said first switching selectors, for receiving the second binary bit signals, and for supplying decoder output signals to the inputs of said transistors included in said first switching selectors.

5. The device according to claim 1, wherein said data division driver means comprises:

shift register means for receiving a clock signal and for generating an output signal in synchronism with the clock signal;

sample/hold circuit means connected to said shift register, for receiving an analog image signal, and for storing the analog image signal in response to the output signal of said shift register;

analog driver circuit means connected to said sample/hold circuit means and the inputs of said parallel transistors included in said second switching selectors, for supplying said block-segmented image data components to inputs thereof;

counter circuit means for receiving the clock signal, for generating a binary output signal; and decoder means connected to said counter circuit means and to the control electrodes of said parallel transistors included in said second switching selectors, for supplying said block data select signals to the control electrodes of the transistors included therein.

6. The device according to claim 1, wherein said data division driver means comprises:

shift register means for receiving a clock signal, an analog image data, and a reset signal, for generating shift output signals;

data latch circuit means connected to said shift register and said inputs of said parallel transistors included in said second switching selectors, for supplying said block-segmented image data components to inputs thereof;

first counter means for receiving the clock signal and the reset signal, for generating a data latch signal which is supplied to said data latch circuit means;

second counter means for receiving the clock signal and the reset signal, for generating a counter output signal; and decoder means connected to said second counter circuit means and to the control electrodes of said parallel transistors included in said second switching selectors, for supplying said block data select signals to the control electrodes of the transistors included therein in response to the counter output signal.

7. The device according to claim 1, wherein said matrix array of display cells have amorphous semiconductor thin-film transistors, and wherein said first and second switching selectors comprise amorphous semiconductor thin-film transistors.

8. The device according to claim 7, wherein said first number of parallel transistors is the same as said second number of parallel transistors.

9. An active matrix type liquid crystal display device comprising:

a substrate;

a display section formed on said substrate and including a matrix array of display cells, address lines connected to row arrays of the display cells, and data lines connected to column arrays of the display cells;

first switching selector means formed on said substrate so as to be connected to said address lines and having address data applied thereto, for sequentially selecting one of the address lines to provide dynamic addressing of said display cells;

second switching selector means formed on said substrate and connected to said data lines, for receiving plural block segments of electrical image data representing an image to be displayed on said display section, each of which block segments associated with a respective one of the data lines, and for sequentially applying in a predetermined order during each selection of an address line by said first switching selector means each of the block segments to the respective data lines associated therewith;

controller means connected to said first and second switching selector means, for supplying address scanning signals to said first switching selector means, for supplying decode output signals as block data select signals to said second switching selector means to transfer sequentially said block-segmented image data components to a corresponding data line;

said controller means applying each of said address scanning signals to a corresponding address line in a predetermined time period which is shorter than the total application time duration of said block data select signals to said data lines; and said address scanning signals having a specific activation time period which is substantially equal to the application time duration of a lastly generated one of said block data select signals.

10. The device according to claim 9, wherein said first switching selector means comprises:

first switching selectors each of which comprises an array of a first number of parallel transistors respectively having inputs and control electrodes which are connected in common with each other.

11. The device according to claim 10, wherein said second switching selector means comprises:

second switching selectors each of which comprises an array of a second number of blocks of parallel transistors respectively having inputs and control electrodes which are connected in common with each other.

12. The device according to claim 11, wherein said controller means comprises:

addressing controller means connected to said first switching selectors, for supplying the address scanning signals to the control electrodes of the transistors included in said first switching selectors, and for causing these transistors to be sequentially rendered conductive.

13. The device according to claim 12, wherein said controller means further comprises:

data division driver means connected to said second switching selectors, for causing the blocks of said transistors of said second switching selectors to be sequentially rendered conductive with the second number of transistors being as a unit thereby to transfer sequentially said block-segmented image data components to a corresponding data line.

* * * * *